United States Patent [19]

Porter

[11] 4,241,681

[45] Dec. 30, 1980

[54] TUBULAR WORK FEEDER FOR SEWING MACHINE

[76] Inventor: Robert E. Porter, 5 Oak St., Hamilton, Mass. 01982

[21] Appl. No.: 50,662

[22] Filed: Jun. 21, 1979

[51] Int. Cl.[3] ..... D05B 27/10; D05B 75/00; D05B 65/00

[52] U.S. Cl. ..... 112/322; 112/242; 112/258; 112/299; 112/321

[58] Field of Search ..... 112/322, 318, 310, 321, 112/299, 242, 243, 258, 63, 23, 24

[56] References Cited

U.S. PATENT DOCUMENTS

| | | | |
|---|---|---|---|
| 600,521 | 3/1898 | Douglas et al. | 112/24 |
| 1,528,719 | 3/1925 | Windham | 112/299 |
| 1,626,329 | 4/1927 | Cortese | 112/299 |
| 1,849,333 | 3/1932 | Myers | 112/23 |
| 2,367,145 | 1/1945 | Sheldon | 112/322 |
| 2,730,977 | 1/1956 | Hayes et al. | 112/322 |
| 2,766,709 | 10/1956 | Stevens | 112/63 |
| 3,530,809 | 9/1970 | Porter | 112/310 |
| 3,640,236 | 2/1972 | Nicolay | 112/243 |
| 3,890,911 | 6/1975 | Babson et al. | 112/121.12 |
| 3,995,571 | 12/1976 | Porter | 112/310 |

*Primary Examiner*—H. Hampton Hunter
*Attorney, Agent, or Firm*—Kenway & Jenney

[57] ABSTRACT

Circumferential stitching of a tubular workpiece is assisted by means of a moving support and feed system which includes a rotatable drum of smaller diameter than the workpiece having an upper end surface positioned adjacent to a stitching station with a conventional stitching mechanism. The workpiece is prepared for stitching by pulling it axially onto the drum like a sleeve. The portion of the workpiece to be stitched is then advanced transversely through the stitching station by a puller which engages the top of the workpiece while the drum is rotated synchronously to keep the workpiece from twisting. A portion of the drive system for the stitching mechanism runs through the interior of the rotating drum. A blind cutter next to the stitching station enables the operator to cut excess thread inside the workpiece after stitching simply by moving the workpiece in a certain manner. The apparatus is particularly designed for sewing a series of spaced reinforcing rings on a long flexible tube of fireproof fabric.

9 Claims, 10 Drawing Figures

FIG. 8
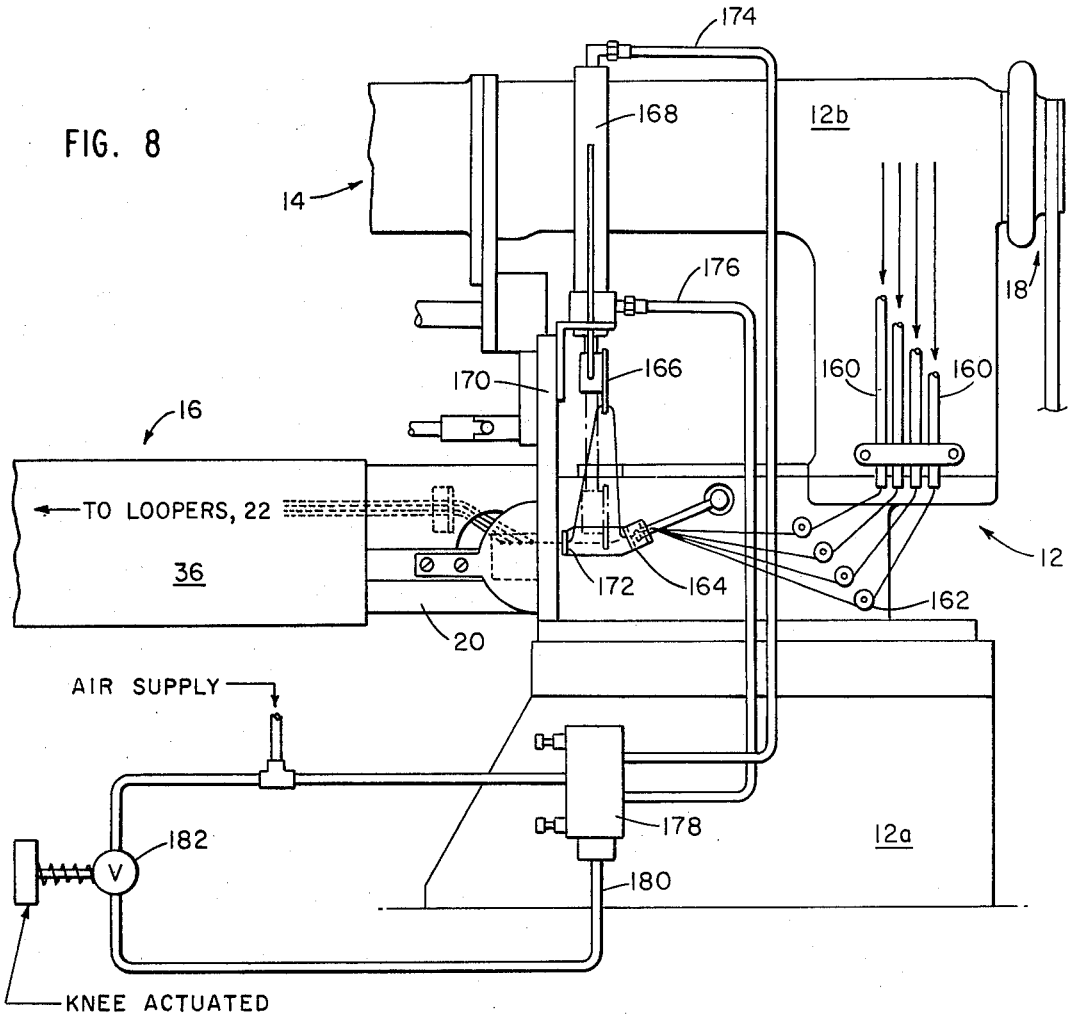
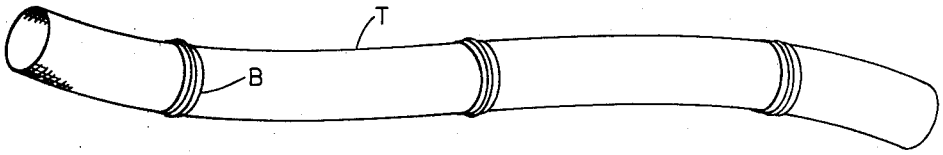
FIG. 10

TUBULAR WORK FEEDER FOR SEWING MACHINE

BACKGROUND OF THE INVENTION

The present invention relates to improvements in workpiece handling apparatus for sewing machines. Sewing machines normally have a feed mechanism which advances the material continuously or stepwise past the stitching mechanism so that consecutive stitches will be evenly spaced. The most common type of feed mechanism is the reciprocating lower feed dog disposed in an opening of the work surface of the sewing machine. The feed dog unusually advances the underlayer of material stepwise. A puller or puller mechanism is often added in industrial sewing machines to advance the top surface of the material. For example, pullers (so called because they are located downstream of the stitching area) are frequently used for sewing bulky material. In this case, the puller is driven in synchronism with a feed dog engaging the undersurface of the material to achieve relatively uniform motion for the entire thickness of the workpiece as it passes through the stitching area. In some machines a synchronously reciprocating feed dog is arranged to engage the top surface of the material. Examples of top feed dog mechanisms are shown in U.S. Pat. Nos. 3,530,809 and 3,995,571 to Robert E. Porter.

In a conventional sewing machine upper and lower horizontal arms are connected at respective ends to an upright base, and the stitching area is defined between the other ends of the arms. Normally the lower arm and upright base rest on a table and support the machine. The coacting upper and lower parts of the stitching mechanism are connected to a source of drive power through the respective horizontal arms. The resulting U-shaped configuration provides positive mechanical linkage between the two parts of the stitching mechanism while affording a work area large enough for most sewing tasks. Normally when sewing one part of the workpiece, the lateral trailing portion of the material is hand-fed over the top of the lower arm as necessary. Advancing the lateral trailing position permits it to keep up with the sewn portion to avoid impeding the stitching progress. Where the stitching is extremely fast or the lateral trailing portion is extremely large or of unusual configuration, feed problems can arise. One such operation involves a long flexible tubular workpiece where the object is to provide stitching encircling the outer surface between the ends of the workpiece. First, the lower arm must be fully cantilevered from the upright base to permit the arm to receive the workpiece like a sleeve. However, even then, the length of the lateral trailing portion of the workpiece and its close fit around the lower arm combine to interfere with the feed. Thus this sewing task—circumferential tube stitching—is one for which conventional sewing machines are unsuited for mass production where frequent feed problems should be eliminated by proper machine design.

Accordingly, the primary object of the present invention is to provide an improved workpiece handling system for a sewing machine for circumferentially stitching a tubular workpiece.

SUMMARY OF THE INVENTION

Generally, the present invention provides improved means for advancing a portion of a tubular workpiece past the stitching mechanism while synchronously advancing the lateral trailing portions of the workpiece surrounding the lower arm of the sewing machine. According to the present invention, therefore, improvements are provided in a sewing machine to support and feed a tubular workpiece.

An elongated cylindrical drum of smaller diameter than the workpiece is mounted for rotation upon the lower arm. One upper end surface of the drum is adjacent to the stitching station defined by the stitching mechanism at the outer ends of the arms. The parallel upper and lower arms are extended and fully cantilevered from the upright base preferably by using tensioning apparatus. The workpiece is prepared for stitching by pulling it axially onto the drum like a sleeve. The portion of the workpiece to be stitched is then advanced transversely through the stitching station preferably by a puller which engages the top of the workpiece while the drum is rotated synchronously with the puller to keep the workpiece from twisting. Meanwhile, the lower portion of the stitching mechanism is driven by a mechanical linkage which runs through the interior of the drum. The stitching mechanism, puller and drum are mechanically connected to a common source of drive power at the upright base.

In a preferred embodiment, a blind cutter next to the stitching station enables the operator to cut excess thread inside the tubular workpiece simply by moving the workpiece in a certain manner. A specially designed thread pull-off mechanism provides slack for the blind cutting operation. The top puller in the preferred embodiment comprises a driven roller with a coaxial groove to accommodate a solid reinforcing ring to be sewn onto the tubular workpiece. The puller roller is urged toward a cooperating parallel idler roller protruding through the surface of the end of the lower arm. The idler roller is adjustable to accommodate rings of different sizes. Preferably the top puller and conventional presser foot are simultaneously retractable by respective air cylinders operated by a single treadle. To accommodate retraction the drive for the puller roller employs a universal-jointed shaft. The apparatus is particularly designed for sewing a series of spaced reinforcing rings on a long flexible tube of fireproof fabric.

BRIEF DESCRIPTION OF THE DRAWINGS

Other objects, features, and advantages of the invention will appear from the following description of a preferred embodiment thereof, taken together with the accompanying drawings, in which:

FIG. 8 is a detail side elevation of the upright portion of sewing machine of FIG. 1, illustrating schematically a portion of the thread pull-off system omitted in FIG. 1 for clarity;

FIG. 10 is an isometric pictorial representation of the finished product of the sewing machine of FIG. 1.

DETAILED DESCRIPTION OF A PARTICULAR PREFERRED EMBODIMENT

Figures 1, 2:
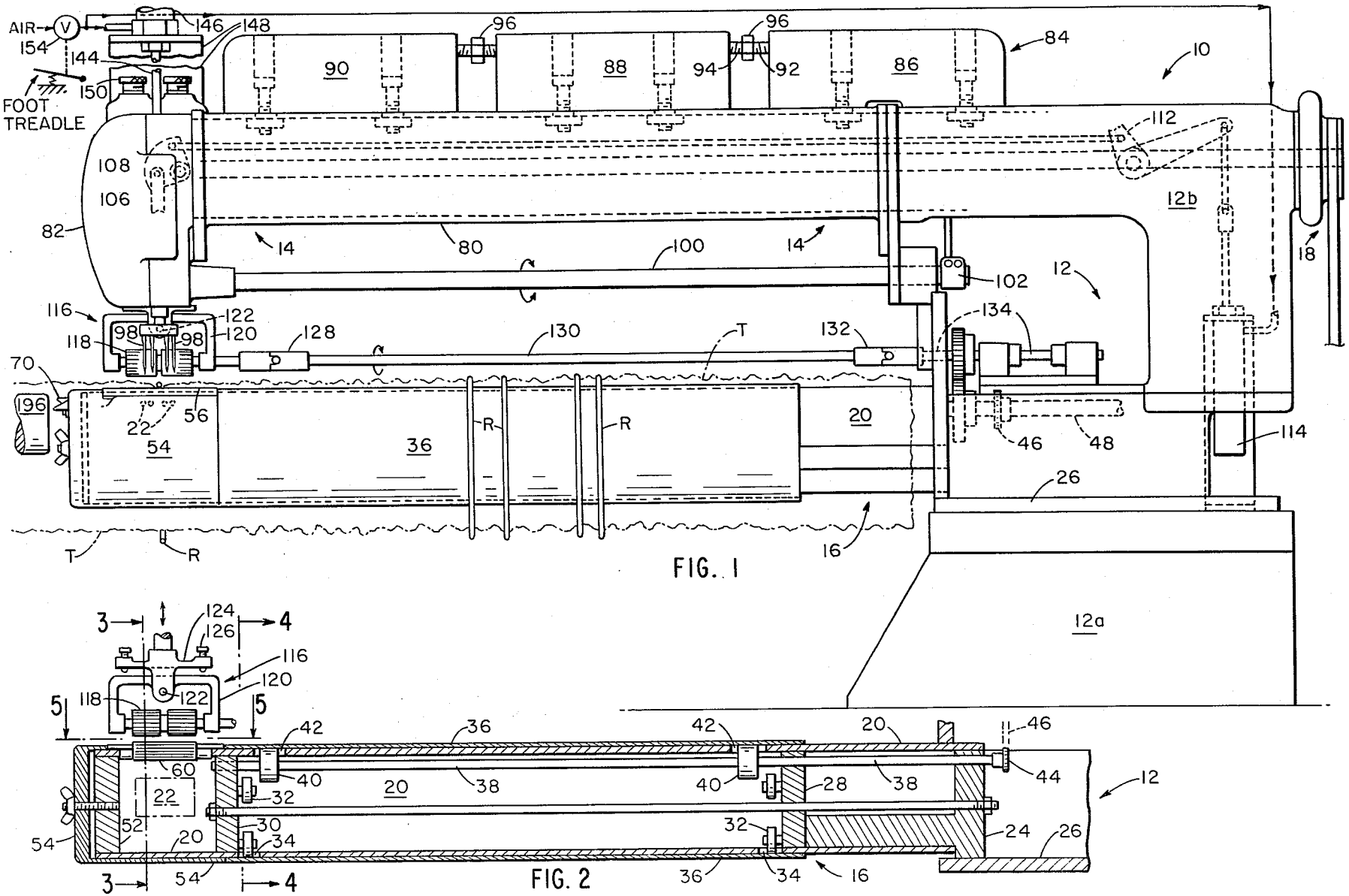
FIG. 1 is a side elevation of a sewing machine incorporating the improved tubular workpiece handling system according to the invention.
FIG. 2 is a detail sectional view of the interior of the lower arm of the sewing machine of FIG. 1 taken at 2—2 of FIG. 3.

FIG. 1 shows a sewing machine 10 modified according to the invention. While the present invention may be applied to any of a wide variety of sewing machines, for purposes of illustration the drawing depicts a machine of the type known as a needle feed or walking needle, chain stitching industrial sewing machine, for example, Singer Model No. 302W206. The configuration of this machine has been extensively modified from its currently available form for example, by cantilevering and greatly extending the length of the upper and lower arm assemblies while utilizing many of the features of the original machine, including, for example, the source of drive power and the stitching mechanism. Reference is made to a particular existing machine for the sake of focusing on the features of the invention which are new and for the purpose of setting one background in which the present invention is operative. Various conventional details have been eliminated from the drawing in order not to obscure the construction and operation of the modifications and improvements according to the present invention.

The sewing machine 10 includes an upright base 12 supporting respective ends of an upper arm assembly 14 and a lower arm assembly which extends horizontally in approximately the same vertical plane from the base 12. The base 12 includes a lower base portion 12*a* normally bolted to a table, and an upper base portion 12*b* housing various conventional drive elements and carrying various conventional thread tensioning and guiding apparatus. Power is supplied to the machine by a belt-driven pulley 18 aligned with the upper arm assembly. With the exception of the pneumatic systems described below, all of the mechanical power for the various moving elements of the sewing machine is derived from the pulley 18. Details of the drive mechanisms are omitted, of course, where they are identical with those in the original sewing machine identified above except where they serve to clarify the modifications.

Figure 4:
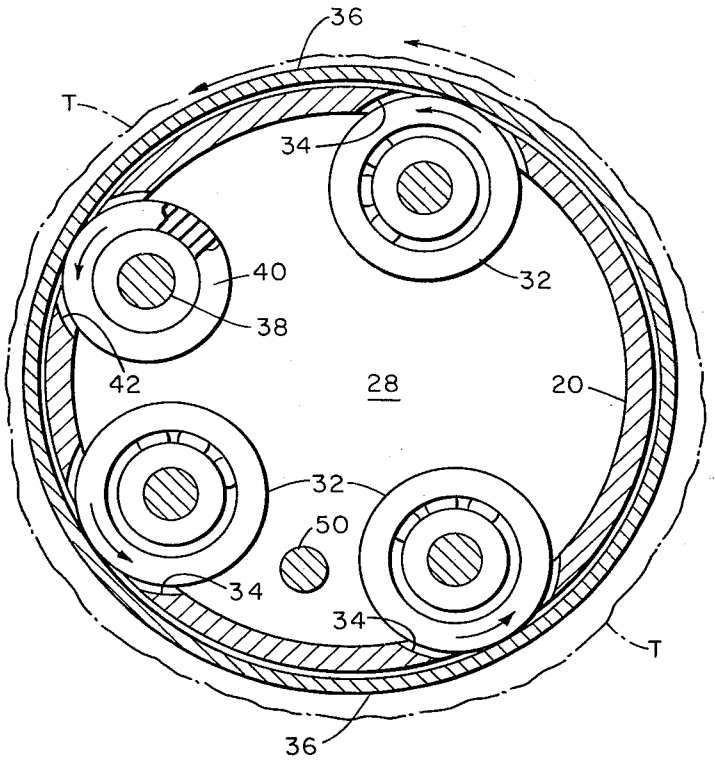
FIG. 4 is a cross-sectional view of the lower arm taken at 4—4 of FIG. 2.

The lower arm assembly 16, as shown in FIGS. 1, 2, and 4, includes an apertured stationary cylindrical support or inner sleeve 20 extending to the outer end of the lower arm assembly 16. The diameter should be chosen as the minimum necessary to accommodate the conventional looper mechanism or loopers 22 (partly shown in FIG. 5) housed within the cavity at the outer end of the lower arm assembly 16 inside the sleeve 20 directly below the stitching area. The inner sleeve 20 is secured to a mounting bracket 24, actually a part of the original casting, which in turn is secured to plate 26 on the base 12. An apertured, circular inner mounting plate 28 is affixed to the bracket 24 across the inner circumference of the inner sleeve 20. A similar outer mounting plate 30 is affixed to the inner circumference of the sleeve 20 adjacent to the loopers 22. Three rollers 32 are coplanarly mounted for rotation on each of the circular mounting plates 28 and 30. The rollers 32 on each mounting plate are positioned so that their outermost surfaces which protrude through corresponding apertures 34 in the sleeve 20, lie on a circle centered on the axis of the inner sleeve 20. A workpiece-supporting cylindrical drum 36 is coaxially received on the inner sleeve 20 and supported for rotation about its cylindrical axis on the rollers 32 which make contact with the inner circumference at either end of the drum 36. The outer end of the drum 36 is next to the stitching area above the loopers 22. A drum drive shaft 38 extends parallel to the axis of inner sleeve 20 near the inner periphery thereof and is journaled for rotation within the mounting plates 28 and 32. The drive shaft 38 carries a pair of spaced, resilient, friction drive rollers 40. Each roller 40 protrudes partly through respective apertures 42 through the inner sleeve 20. The shaft is positioned so that the outer surface of the rollers 40 makes driving contact with the inner circumference of the drum 36. A sprocket wheel 44 is coaxially secured to the inner end of the drive shaft 38 which extends inwardly through the mounting bracket 24. The gear 44 is driven by chain 46 connected to a sprocket wheel (not shown) on a drive shaft 48 forming an original part of the upright base 12 of the sewing machine (FIG. 1). The gearing for the drum drive is designed so that the top axial surface of the drum moves transversely at the feed rate determined by the walking needle feed and puller mechanism described below.

The drive linkage for the looper mechanism is formed by an oscillating shaft (not shown) parallel to the tensioning rod 50. The oscillating looper shaft passes through corresponding apertures in the plates 28 and 30 and is an extension of the oscillating shaft in the original machine to accommodate the extra length of lower arm assembly 16.

Figure 3:
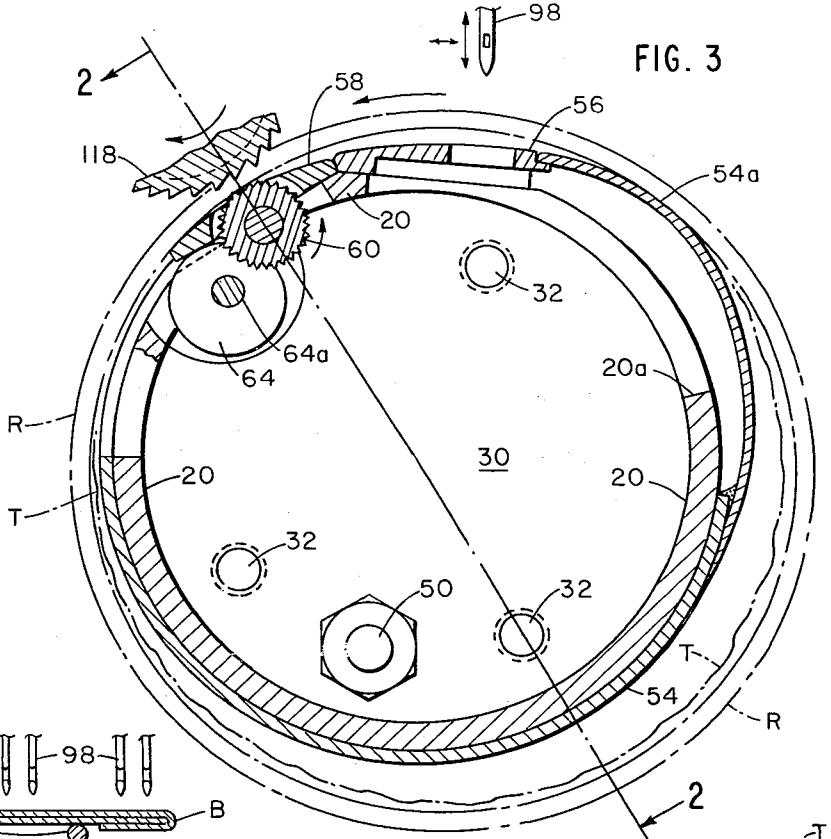
FIG. 3 is a cross-sectional view of the lower arm taken at 3—3 of FIG. 2.
Figure 5:
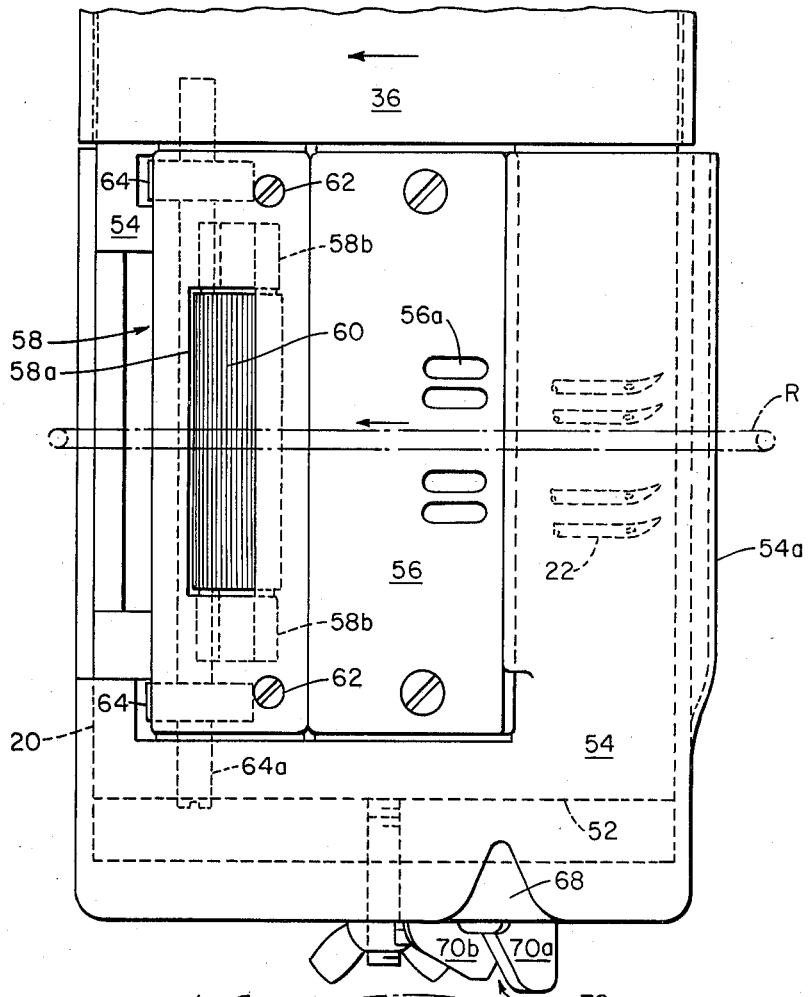
FIG. 5 is a top view of the end of the lower arm taken at 5—5 of FIG. 2, illustrating the blind cutter and stitching surface with a ring in phantom.
Figure 6:
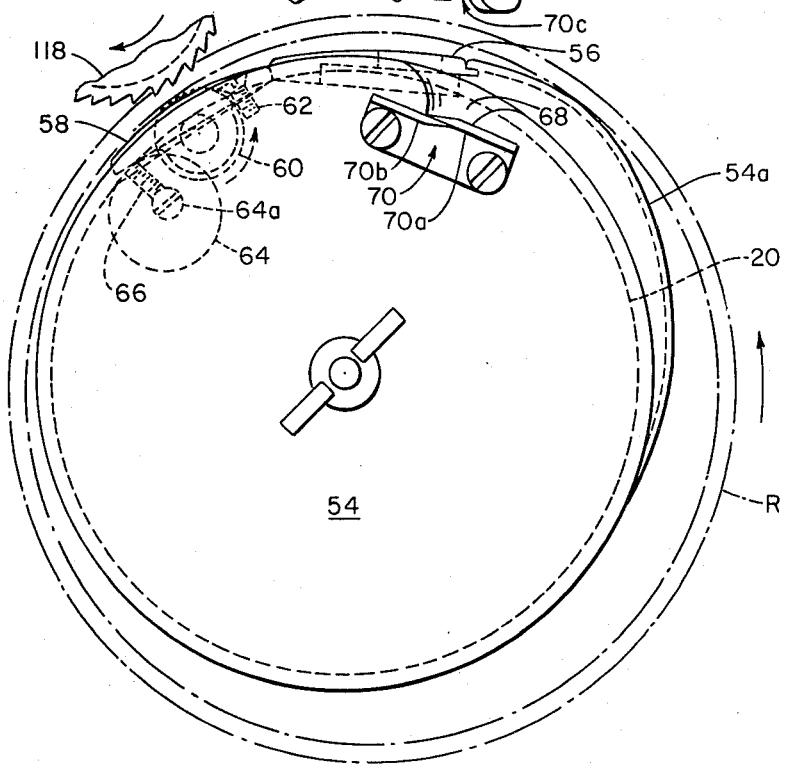
FIG. 6 is an end elevation of the lower arm of FIG. 2, showing the blind cutter and the idler roller adjusting cam and a ring in phantom.

As shown in FIGS. 2, 3, and 5, an apertured, cup-shaped, removable end cap 54 is secured coaxially on the outer end of the inner sleeve 20 in nearly abutting relationship with the rotatable drum 36. Removal of the end cap 54 provides access to the loopers 22 through an aperture 20*a* (FIG. 3) in the inner sleeve 20. The end cap 54 includes a rectangular throat plate 56 attached with screws to the inner sleeve 20. The throat plate 56 has two pairs of aligned oblong stitching needle apertures 56*a* defining the stitching area (FIG. 5). Next to the throat plate 56, and below and downstream therefrom in the feed direction, indicated by the arrow in FIG. 5, an adjustable hinge-like roller bracket 58 has a rectangular window 58*a* through which a serrated idler roller 60 protrudes. The idler roller 60 is journaled in flanges 58*b* carried underneath the roller bracket 58. The side of the roller bracket 58 adjacent to the throat plate 56 is connected to the inner sleeve 20 by means of screws 62. The height of the opposite side of the roller bracket 58 in relation to the adjoining surface of the end cap 54 is adjusted by means of a pair of rotatable eccentric cams 64. A set screw 66 threaded through the inner sleeve 20 secures the outer end of the cam axle 64*a*. The cams 64 are adjusted by means of a slotted end of the axle 64*a* through an aperture in the end plate 52. As shown in FIG. 6 the height of the idler roller 60 is adjusted so that the roller makes contact with the reinforcing ring R for the workpiece.

The thin-walled blister 54*a* on the end cap 54 as shown in FIGS. 5 and 6 is present only if necessary to accommodate the size of the looper mechanism 22.

The blind cutter shown in FIGS. 5 and 6 includes a smooth V-shaped notch 68 formed in the upper edge of the end cap 54 approximately in line with the upstream edge of the throat plate 56. A blade assembly 70 is attached to the flat end of the cap 54 at the lower edge of the guide notch 68. The blade assembly 70 includes a pair of overlapping blades 70*a* and 70*b* having diagonal cutting surfaces forming a protected V-shaped cutting surface 70*c*. The operator can pull looper thread from the holes 56*a* and slide it over the edge of the cap 54 until it engages the guide notch 68 whereupon a downward motion engages the thread with the cutting surface 70*c* in a manner which is very easy to feel. Ease of cutting is important since the view is obstructed by the workpiece.

Figure 7:
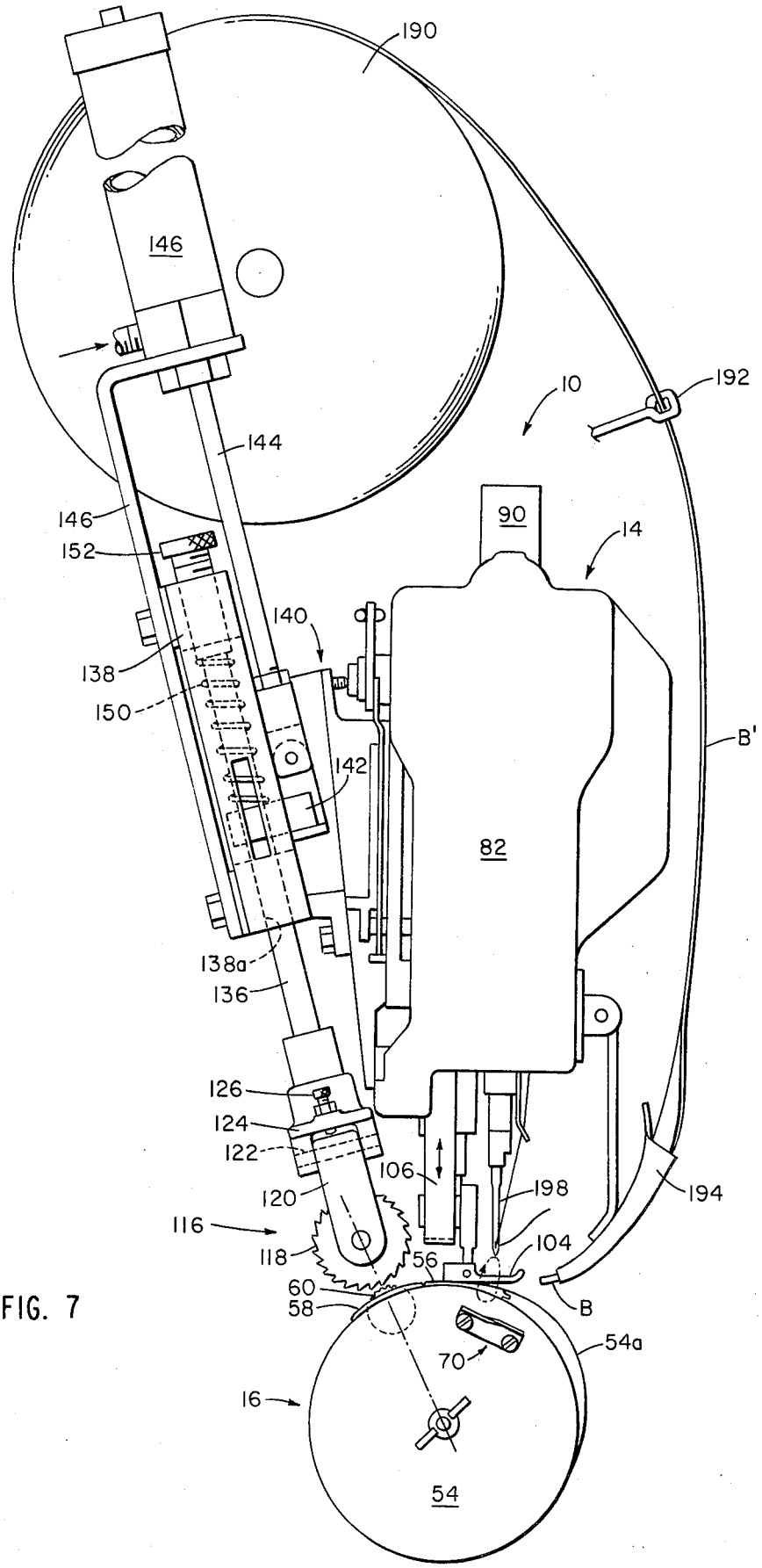
FIG. 7 is an end elevation of the stitching end of the sewing machine of FIG. 1, particularly showing the apparatus of the upper arm and schematically illustrating a factory installation additionally including a feed reel arrangement for the outer strapping.

The upper arm assembly 14, shown in FIGS. 1 and 7, includes an extension tube 80 between the original upper base portion 12*b* and the original sewing head 82. The sewing head 82 houses a conventional multiple needle stitching mechanism (not shown) preferably of the type that produces a walking needle feed motion. To support the weight of the upper arm assembly 14, tensioning bridgework 84 is provided along the top of the arm. The bridgework 84 includes three rectangular blocks 86, 88, and 90 vertically bolted to the top of the upper arm assembly 14. Block 86 spans the interface between the extension tube 80 and the upper base portion 12*b* and is bolted to both parts. The other blocks 88 and 90 are bolted directly to the top of the extension tube 80. Toward the top of the gap between blocks 86 and 88, a short threaded stud 92 projects from block 86 parallel to the arm assembly 14. Another stud 94 threaded in the opposite sense from stud 92 projects from the adjacent block 88 in spaced alignment with stud 92. The studs 92 and 94 are joined by a threaded nut 96. Rotation of the nut 96 draws the opposed faces of the adjacent blocks 86 and 88 together. A similar arrangement is employed between blocks 88 and 90. Tightening the nuts 96 helps counteract any tendency of the upper arm assembly 14 to deflect under the weight of the sewing apparatus at its outer end. Additional tensioning apparatus may be arranged on the side of the upper arm assembly 14 to increase lateral stability if necessary.

The stitching needle mechanism inside the sewing head 82 carries four coplanar stitching needles 98 arranged in two spaced pairs. The needles, which operate in unison, dip into the holes 56*a* (FIG. 5) during each reciprocation. Extension shaft 100 parallel to the upper arm assembly 14 interconnects the sewing mechanism in the head 82 with its regular oscillating drive 102 on the upper base portion 12*b*. The oscillating shaft 100 powers the walking or feed motion of the stitching needle mechanism while the vertical reciprocating component is powered by extended linkage (not shown) through the tube 80. A retractable presser foot 104 (FIG. 7) is connected by reciprocating link 106 to a bell crank 108 in the head 82 operated by an extension link 110. The inner end of link 110 is connected to bell crank 112 on the base 12 actuated by a single-acting spring-return air cylinder 114 (FIG. 1).

The puller mechanism 116 (FIGS. 1, 2, and 7) includes a serrated roller 118 having two integral aligned roller surfaces spaced by a coaxial groove dimensioned to accommodate the reforcing ring R which is to be sewn onto the fabric tube T. The roller groove coincides with the space between the pairs of needles 98 thus insuring that the ring will be centered between two rows of stitches. The axle of the puller roller assembly 118 is journaled in the ends of an equalizer yoke 120 pivotally connected at the center of the upper base portion by pin 122 to the T-shaped arm 124. Set screws 126 carried on either side of arm 124 impinge against the upper surface of the yoke 120 and limit pivoting of the yoke.

The axle of the roller 118 extends through the end of the yoke 120 toward the base and terminates in a universal joint 128 connected to a shaft 130 approximately parallel to the lower arm 16. The shaft 130 is connected by another universal joint 132 to a drive shaft 134 journaled on the base 12. The drive shaft 134 is gear driven by the same shaft 48 which drives the chain 46 for rotating the drum 36 on the lower arm assembly 16.

In FIG. 7 the T-shaped adjustment member 124 is connected to a pair of rods 136 (only one of which is in view in FIG. 7) slidably received in rectangular frame 138. Frame 138 is bolted to the sewing head 82 at an acute angle therewith by means of a pair of wedge-shaped mounting brackets 140. The rods 136 are connected above the guide holes 138*a* in the frame 138 by an adjustable clamp 142 to the end of the plunger 144 of a single-acting air cylinder 146. The air cylinder 146 is connected to the retraction frame 138 by means of a bracket 148. Coil compression springs 150 surround the rods 136 inside the frame 138 between clamp 142 and threaded adjustable stops 152.

As shown in FIG. 1 cylinder 146 for the puller roller 118 and cylinder 114 for the presser foot 104 are simultaneously supplied with air through the treadle-operated two-way valve 154. Depressing the treadle retracts the puller mechanism and presser foot from engagement with the workpiece so that the workpiece can be inserted or removed. Releasing the treadle lowers the puller mechanism and the presser foot into engagement with the material.

Sewing thread for the needles 98 is provided from a conventional thread stand having four corresponding spools of thread typically situated beside the base 12. Thread is led from the spools via conventional tensioning apparatus (not shown) on the upper base portion 12*b* into the interior of the upper arm assembly 14 through suitable guides and down through the sewing head 82 to the eyes of the respective needles 98 as shown in FIG. 7. The bell crank 112 of FIG. 1 also operates a lever (not shown) to remove tension from the upper threads when the presser foot is raised as is customary in conventional sewing machines to facilitate removal of the workpiece.

In addition to the stitching needles 98, each of the four loopers 22 (FIG. 5) requires its own supply of thread. Thus, there will be eight spools on the thread stand. In FIG. 8 the thread for the loopers 22 is led through four respective vertical guide tubes 160 along the side of the base 12, past four pulleys 162 to a fixed four-hole guide 164 which reorients the threads to a plane perpendicular to the plane of the overall U-shaped configuration of the sewing machine. The thread then passes through a specially designed two position four-hole guide 166 mounted on the end of the plunger of a double-acting air cylinder 168 which is attached to the frame member 170 on the base 12. The thread then passes through a fixed four-hole guide 172 into a lateral opening in the lower arm assembly 16 into the interior of the inner sleeve 20. Guide holes (not shown) are formed through mounting plates 28 and 30 (FIG. 2) to lead the thread through the inner sleeve 20 to the loopers 22.

In FIG. 8 the movable guide 166 is shown in its upper position. In its lower position, guide 166 is approximately aligned between guides 164 and 172. The air cylinder 168 which actuates the guide 166 has upper and lower air inlets 174 and 176 connected to a four-way valve 178. The valve 178 is connected to a supply of pressurized air. The control inlet 180 of the valve 178 is connected to the air supply via a knee-actuated valve 182. In the normal closed condition of valve 182, the four-way valve 178 is biased so that the upper inlet 174 is supplied with air while the lower inlet 176 is vented. When the knee valve 182 is actuated, the upper inlet 174 is vented and the lower inlet 176 is pressurized, thus raising the piston in the cylinder 168 to which the movable guide 166 is connected. Releasing the valve 182 allows the guide 166 to return to its normal lower position. The purpose of this arrangement is to produce a predetermined amount of slack in the thread supply instantly by momentarily actuating guide 166. This slack allows the operator to pull the workpiece away from the end of the lower arm assembly 16 a predetermined distance until the lower thread is taut. The operator then draws the thread toward the blind cutter 70 by moving the workpiece downward and sliding it over the edge of the end cap 54 (FIG. 5).

Figure 9:
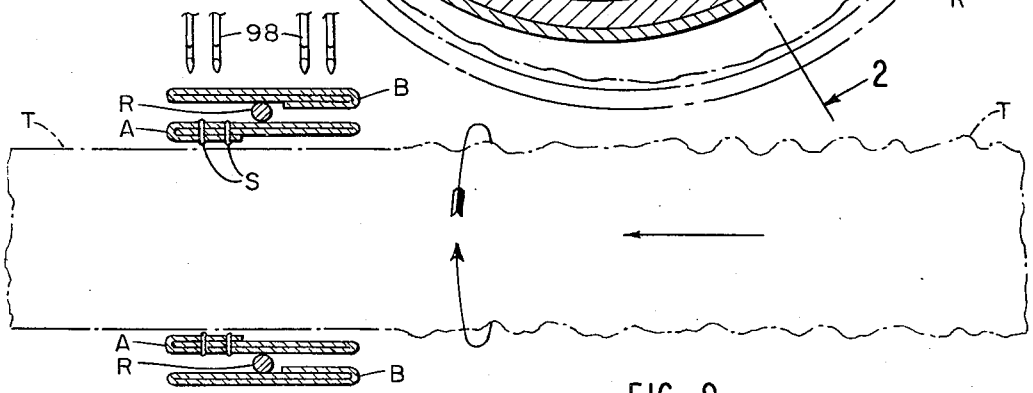
FIG. 9 is a sectional view of the reinforcing ring assembly showing its relationship to the needles, with the tubular workpiece in phantom.

The above-described sewing machine is designed for sewing reinforcing rings on the outside of a relatively long sleeve-like tube of fireproof fabric such as fiberglass mesh. A typical tube is 18 feet long with a six inch diameter. As shown in FIG. 9 the reinforcing rings have three parts, a precut, prefolded inner strap A with presewn stitches S, a solid metal reinforcing ring R and an outer strap B. As shown in FIG. 7 the outer strap B is supplied from an overhead reel 190. The unprefolded strap B' passes through a ring guide 192 and a conventional folding guide 194 which is pivotally mounted to the sewing machine head 82 so that it can be moved out of the way. The folded strap B exits the bottom of the folding guide 194 and passes under the presser foot as it is sewn in place.

In use, the puller mechanism and presser foot are raised by depressing the treadle in FIG. 1, and the fabric tube T is pulled onto the lower arm like a sleeve. The tube may be bunched up on the arm to the extent necessary. If not all of the tube can be placed on the arm then one half of the tube can be sewn at one time and the tube can be reversed to sew the other half. Several steel reinforcing rings R are slipped over the tube T onto the arm assembly 16 and an independent work receiving stub or arm 196 (FIG. 1) is aligned with the end of the lower arm assembly 16 to receive the work as it is sewn. Next, the operator drapes a pre-made strap A, as shown in FIG. 9, over the tube T at a premarked axial location and positions a ring R over the inner strap A. The strap B as shown in FIG. 7 is brought down on top of the ring under the raised presser foot 104. As the treadle is released, the puller mechanism and presser foot engage the strap material and center the ring. Another switch (not shown) engages the drive system which then operates the work support drum 36, puller 116, loopers 22 and stitching needles 98 synchronously. After a complete circle of four parallel rows of stitches has been sewn, the drive system is disengaged, the puller and presser foot are lifted, the outer strap 13 and upper threads are cut by hand, and the knee valve is actuated to slacken the lower thread. After the lower thread is cut with blind cutter 70, the portion of the tube just sewn is moved onto the receiving arm 196.

The above-described modifications make circumferential stitching on a long, small diameter tube a relatively simple operation. The lateral trailing portion of the tube on the lower arm is prevented from twisting and binding by the rotating drum 36. The motion of the drum keeps the upper surface of the tube between the stitching area and the base 12 advancing at the same rate thus freeing the operator from keeping the material straight while sewing. The use of the driven puller to advance the upper surface of the material improves the feed of the multiple element workpiece. Because of the universal linkage, the puller is positively driven synchronously with the stitching mechanism and rotating drum 36 at all times to ensure even stitches. Moreover, the radial location of the puller downstream and below the stitching area reduces the size of the end of the lower arm assembly permitting smaller diameter workpieces. The idler roller is fully adjustable by means of a special cam arrangement to accommodate rings of different sizes. The thread slackening arrangement permits the operator to create a predetermined amount of slack at the press of a knee and the blind cutter allows the operator to cut the lower thread inside the tube merely by moving the tube in a certain manner. In conjunction with an overhead outer strapping feed, the modified sewing machine can sew a series of reinforcing rings on a long fabric tube quickly without the difficulties encountered in the past. Moreover, the apparatus can be used for other sewing operations, particularly long sleeve-like constructions wherein circumferential stitching in an encircling patern is required.

While a particular preferred embodiment of the present invention has been illustrated in the accompanying drawing and described in detail herein, other embodiments are within the scope of the invention and the following claims.

I claim:

1. In a machine for circumferentially stitching a tubular workpiece, said machine having a source of drive power, a workpiece support having a stitching station removed from said source of drive power and cooperating stitching needle means at said stitching station and feed means for feeding the portion of said workpiece to be stitched through said stitching station at a selected feed rate in a given direction of advancement, said needle means and feed means being operated synchronously by said source of drive power, the improvement comprising a tubular workpiece support of relatively great length and relatively small diameter and feeding system including:

a cylindrical drum of smaller diameter than said workpiece mounted for rotation upon said workpiece support and extending axially from a point adjacent said stitching station toward said source of drive power, the top of said drum parallel to its axis being aligned with said stitching station at right angles to said direction of advancement; and first drive means connected to said source of drive power for synchronously rotating said drum to cause the top of said drum to move at said feed rate in said direction of advancement, whereby portions of said workpiece surrounding said drum near to and distant from said stitching station are conveyed over the workpiece support at said feed rate.

2. In a machine as defined in claim 1, the further improvement wherein said feed means includes puller means located immediately downstream in the direction of advancement from said stitching station for drivingly engaging the top of said workpiece to advance said portion of said workpiece through said stitching station at said feed rate.

3. In a machine as defined in claim 1, the further improvement wherein said workpiece support terminates in a substantially cylindrical apertured end providing said stitching station, said cylindrical end being aligned with said drum, an idler roller rotatably mounted parallel to the axis of said cylindrical end in an aperture therein immediately downstream from and below the level of said stitching station, said puller means including a puller roller mounted in parallel to said idler roller above said cylindrical end, second drive means connected to said source of drive power for rotating said puller roller and means for urging said puller roller against said idler roller to advance said workpiece.

4. In a machine as defined in claim 3, the further improvement wherein said feed means includes means for retractably positioning the axis of said puller roller in a plane approximately including the axes of said idler roller and said cylindrical end.

5. In a machine as defined in claim 4, the further improvement wherein said second drive means includes a drive link approximately parallel to said drum, first universal joint means for connecting one end of said link to said source of drive power and second universal joint means for connecting the other end of said link to said puller roller for imparting rotation thereto.

6. In a machine as defined in claim 1, wherein said cooperating stitching needle means includes a lower stitching mechanism beneath said stitching station and drive means therefor powered by said source of drive power and means for supplying thread thereto under tension, the improvement further comprising said lower stitching mechanism drive means and thread-supplying means extending to said lower stitching mechanism through the interior of said drum.

7. In a machine as defined in claim 6, the further improvement comprising blind cutter means operatively positioned on the end of said support away from said source of drive power for cutting thread supplied from said lower stitching mechanism inside said tubular workpiece when said workpiece is pulled away from said source of drive power with a predetermined motion.

8. In a machine as defined in claim 7, the further improvement comprising means for developing on command a predetermined amount of slack in the thread supplied to said lower stitching mechanism sufficient to permit said workpiece to be pulled to a point of operative engagement of said blind cutter means substantially without tension in said thread.

9. In a machine as defined in claim 6, the further improvement wherein said workpiece support includes a frame, a plurality of wheels and means for rotationally mounting said wheels to said frame at locations within said drum circumferentially and axially spaced to support said drum for rotation about its axis, said first drive means including at least one of said wheels.

* * * * *